United States Patent [19]

Snavely

[11] 3,988,870

[45] Nov. 2, 1976

[54] LAMP POST BASE

[76] Inventor: Donald D. Snavely, 6942 Knollwood Drive, Morrow, Ga. 30260

[22] Filed: July 2, 1975

[21] Appl. No.: 592,644

Related U.S. Application Data

[63] Continuation of Ser. No. 463,855, April 25, 1974, abandoned.

[52] U.S. Cl. ..... 52/296; 52/297; 52/301

[51] Int. Cl.[2] ..... E04H 12/00; E02D 27/00

[58] Field of Search ..... 52/220, 296, 722, 295, 52/297, 40, 146, 155, 301

[56] References Cited

UNITED STATES PATENTS

| | | | |
|---|---|---|---|
| 450,385 | 4/1891 | Gersch | 52/297 |
| 595,217 | 12/1897 | Speyer | 52/297 |
| 1,026,801 | 5/1912 | Haase | 52/220 |
| 1,189,459 | 7/1916 | Lundin | 52/295 |
| 1,718,253 | 6/1929 | Putnam | 52/220 |
| 1,725,244 | 8/1929 | Bareham | 240/84 |
| 2,114,058 | 4/1938 | Mahoney | 52/40 |

FOREIGN PATENTS OR APPLICATIONS

| | | | |
|---|---|---|---|
| 395,628 | 7/1933 | United Kingdom | 52/297 |
| 1,171,374 | 11/1969 | United Kingdom | 52/301 |

*Primary Examiner*—James L. Ridgill, Jr.

[57] ABSTRACT

A lamp post base is disclosed comprising a hollow cylinder having a centrally apertured upper end, a centrally apertured lower end of surface area substantially less than said upper end, interior walls defining a conical bore, and a set of passageways extending from the interior walls to the exterior surface of the cylinder between the lower and upper ends.

2 Claims, 3 Drawing Figures

LAMP POST BASE

This is a continuation of application Ser. No. 463,855, filed Apr. 25, 1974, now abandoned.

BACKGROUND OF THE INVENTION

This invention relates generally to lamp post bases, and particularly to precast type lamp posts adapted to support relatively large outdoor lamps along streets and highways, in automobile parking lots, and the like.

Precast bases have heretofore been devised for supporting outdoor lamps, telephone and power transmission lines as exemplified by U.S. Pat. Nos. 1,624,237, 2,374,624 and 3,343,322. The precasting of such bases at manufacturing plants is substantially less expensive and time consuming than forming the support foundations on site. In using precast bases trench linked holes are formed in the supporting terrain by use of truck-borne arbors or mobile post hole diggers. Electrical wiring is then laid in the trenches and guided through openings in the bases which are then seated in the holes and the terrain compacted laterally thereabout. The lamps are electrically connected to the wiring protruding out the tops of the bases. The lamp posts are then bolted to the tops of the bases at a point either flush with the surrounding terrain or elevated thereabove to prevent damage from being incurred by automobiles bumping into the posts themselves.

Though lamp post bases of the prior art have provided a distinct improvement over those of the type previously cast in situ, several problems associated with their use have remained. Chief among these problems has been the difficulty in quickly and efficiently forming holes in the terrain into which the bases may be snugly set without need for substantial repacking of the terrain or conversely, extracting additional earth from the holes which may have crumbled into the center thereof during digging. In addition, arbors typically supported upon trucks used in digging post holes and the like have usually not formed holes compatible in size to that required for setting lamp post bases. Yet another persistent problem has been the dilemma encountered in balancing bore strength with weight specifications. Substantially solid lamp post base construction offers high rigidity and immobility due to their mass but their weight renders them unwieldy and costly to produce and to channel electrical wiring therethrough.

Accordingly, it is a general object of the present invention to provide an improved lamp post base.

More specifically, it is an object of the present invention to provide a precast lamp post base which may be installed in supporting terrain with facility and efficiency.

Another object of the invention is to provide a relatively light weight precast lamp post base which may be set snugly in terrain holes having varying amounts of residual loose earth in the bottom thereof with uniform vertical positioning of the base during the setting operation.

Yet another object of the invention is to provide a lamp post base to which electrical wires may be routed with facility.

SUMMARY OF THE INVENTION

In one form of the invention a lamp post base is provided comprising a hollow cylinder having a centrally apertured upper end, a centrally apertured lower end of surface area substantially less than the upper end, interior walls defining a conical bore, and a set of passageways extending from the interior walls to the exterior surface of the cylinder between the lower and upper ends.

DETAILED DESCRIPTION OF THE DRAWING

Figure 1:
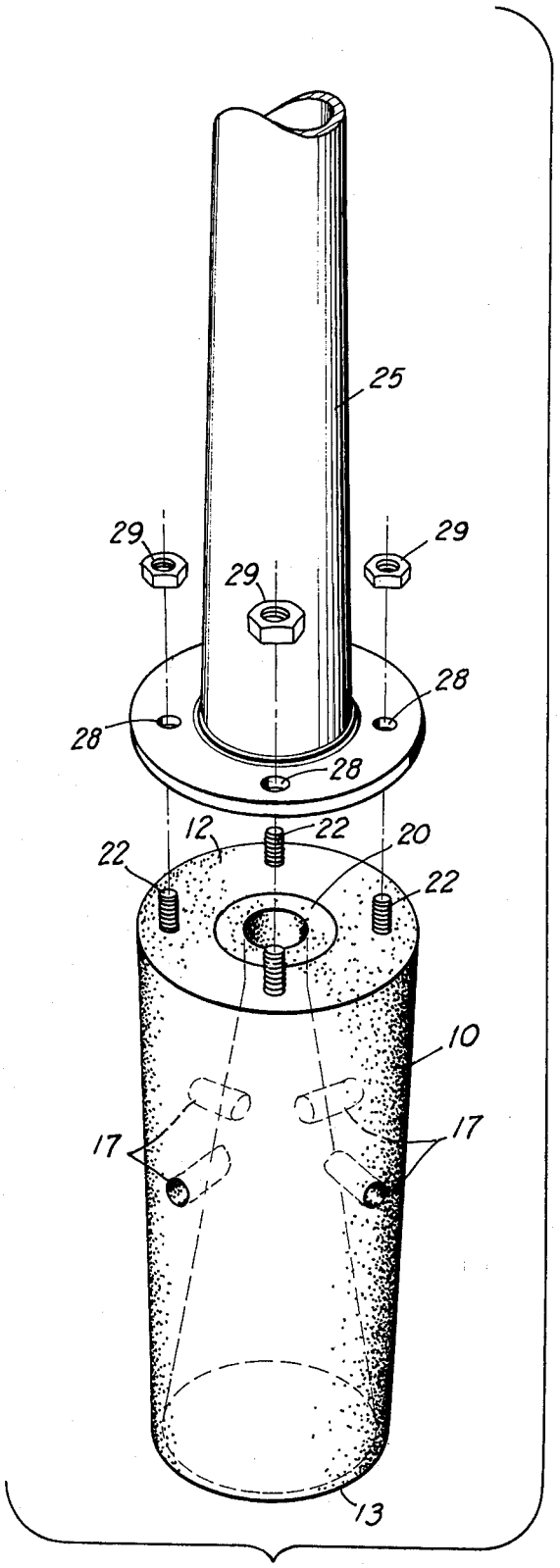
FIG. 1 is an exploded view of a lower portion of a lamp post and of a supporting base which base embodies principles of the invention in one preferred form.
Figure 2:
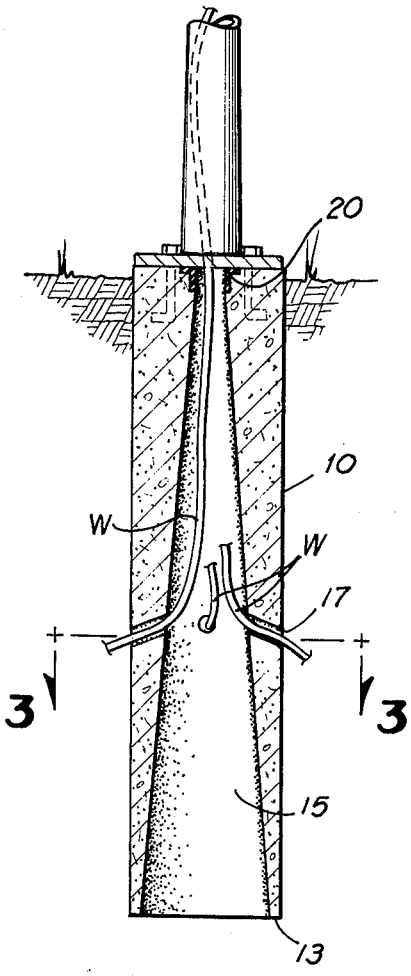
FIG. 2 is a cross-sectional side view of the lamp post base depicted in FIG. 1 shown seated in supporting terrain and with a lamp post rigidly mounted thereatop.
Figure 3:
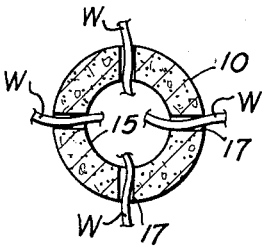
FIG. 3 is a cross-sectional view of the lamp post base shown in FIG. 2 taken along plane 3—3.

Referring now in more detail to the drawing, there is shown a lamp post base comprising a right circular concrete cylinder 10 preferably formed with concrete having segments of wire homogeneously disbursed therein such as Geocrete. The lamp post base has an upper substantially planar end 12 and a lower planar end or rim 13 both of which ends are centrally apertured. The cylinder has interior conical walls 15 which extend between lower end 13 and a small step just beneath upper end 12. With the conical walls enlarging as they descend towards the lower end wall the surface area of the lower end wall itself is substantially less than that of the upper end wall.

In a midsection of the concrete cylinder between the two end walls are integrally formed four angularly spaced, conically positioned passageways 17 which extend from the axis of the cylinder at an angle of some 70° with respect thereto. Through these conduits electrical wires *w* may be passed to couple a light supported on the lamp post with a municipal source of electric current. That these conduits are disposed in the midsection of the lamp post base enables them to be formed in walls of sufficient thickness to prevent cracking or chipping and yet of not such thickness as to render it difficult to guide the wires through the conduits and then turn them upwardly towards the aperture or orifice in the upper end wall.

Seated on an interior step about the lips of the orifice in a recess in upper end wall 12 is a plastic eyelet 20 having a tubular section forming a terminal end of the cylinder bore and a flange section the upper surface of which is disposed coplanar with the upper surface of end wall 12. This plastic eyelet enhances the ease by which wires *w* may be directed through the orifice itself while also serving to inhibit irritation or injury caused by the abrasive Geocrete to the hands of persons guiding the wires *w* through the upper orifice. A set of anchor bolts 22 are also provided projecting upwardly from end wall 12 about eyelet 20.

In installing a lamp post base of the type just described an arbor of size typically employed in digging holes for utility poles and the like may be used to extract a solid cylinder of earth from supporting terrain in which the lamp post base is to be seated. The hollow base is then telescoped downwardly into the hole with the walls of the cylinder passing closely adjacent the walls of the hole. That the lower end 13 consists of but a relatively narrow, annular rim enables loose dirt which may have collected at the bottom of the hole during the digging and implantation operations to be housed within the lower end of the hollow cylinder. To insure proper leveling of the base the hole may intentionally be dug slightly shallow whereby upon seating with a slight portion of the cylinder protruding above the terrain the post may be tapped downwardly forcing the lower end or rim into the soil. With the cylinder now seated in place wiring is routed through one or more passageways 17, up through the cylinder bore, and out the top of the cylinder through eyelet 20. A lamp post 25 having an annular flange 26 at the bottom thereof may be then secured atop the base by registering holes 28 formed in the post flange about anchor bolts 22 and then securing nuts 29 thereon once the wiring or wires *w* protruding out the top of cylinder 10 has been connected to the post supported lamp.

It should of course be understood that the just described embodiment merely illustrates principles of the invention in one preferred form. Many modifications may be made to this specifically described base without departure from the spirit and scope of the invention as set forth in the following claims.

What is claimed is:

1. A lamp post base for receiving and supporting a hollow upstanding electrical lamp post by its bottom flange so that electrical conduits may pass up through the bottom flange and into the hollow interior of said lamp post, comprising:

a. a hollow concrete member having a cylindrical exterior surface and a conical upwardly tapered interior wall forming a bore therethrough, said member being substantially longer than its width and being provided with a flat upper end surface having a central aperture forming the upper opening of said bore and a bottom surface of less surface area than said upper end surface, said bottom surface having a central aperture and forming the lower end of said bore, said upper surface being adapted to receive thereon said flange of said lamp post so that said bore communicates with the hollow portion of said lamp post when said member is aligned with said upper opening;

b. said concrete member being provided with circumferentially spaced passageways extending from said exterior surface inwardly to said interior wall for communicating with the central portion of said bore and for receiving therethrough the electrical cables which then pass up through said bore and into the hollow portion of said lamp post, said passageways each being spaced inwardly from and disposed between said upper end surface and said bottom surface and extending at an incline as it passes inwardly toward and into the central portion of said bore; and c. a plurality of circumferentially spaced anchor bolts embedded in said member, said bolts surrounding said upper central aperture of said upper surface for projecting upwardly through holes in said flange when said flange is received on said upper end surface and is in alignment with said bore;

d. said upper opening having a plastic eyelet having a tubular section secured to a portion of said aperture interior adjacent said upper end surface and a flange portion secured to said upper end surface, said plastic eyelet flange portion being countersunk in an annular recess in said upper end with an exterior surface of said flange portion disposed coplanar with the exterior surface of said upper end.

2. A lamp post base in accordance with claim 1 wherein said hollow member is unitary and consists essentially of a substantially homogeneous mixture of said concrete and metallic wires.

* * * * *